US010208944B2

(12) United States Patent
Mühlbauer et al.

(10) Patent No.: US 10,208,944 B2
(45) Date of Patent: Feb. 19, 2019

(54) SEMICONDUCTOR LAMP HAVING A HEAT SINK

(71) Applicant: OSRAM GmbH, München (DE)

(72) Inventors: Carolin Mühlbauer, Regenstauf (DE); Klaus Eckert, Herbrechtingen (DE)

(73) Assignee: LEDVANCE GMBH, Garching Bei München (DE)

( * ) Notice: Subject to any disclaimer, the term of this patent is extended or adjusted under 35 U.S.C. 154(b) by 194 days.

(21) Appl. No.: 15/120,070

(22) PCT Filed: Feb. 4, 2015

(86) PCT No.: PCT/EP2015/052283

§ 371 (c)(1),
(2) Date: Aug. 18, 2016

(87) PCT Pub. No.: WO2015/124426

PCT Pub. Date: Aug. 27, 2015

(65) Prior Publication Data

US 2017/0227206 A1 Aug. 10, 2017

(30) Foreign Application Priority Data

Feb. 21, 2014 (DE) ..... 10 2014 203 192

(51) Int. Cl.

| | |
|---|---|
| ***F21V 29/71*** | (2015.01) |
| ***F21V 29/89*** | (2015.01) |
| ***F21K 9/237*** | (2016.01) |
| ***F21V 15/04*** | (2006.01) |
| *F21Y 115/10* | (2016.01) |

(52) U.S. Cl.

CPC ..... *F21V 29/713* (2015.01); *F21K 9/237* (2016.08); *F21V 15/04* (2013.01); *F21V 29/89* (2015.01); *F21Y 2115/10* (2016.08)

(58) Field of Classification Search

CPC ..... F21K 9/237; F21V 15/04; F21V 29/89; F21V 29/713; F21Y 2115/10

See application file for complete search history.

(56) References Cited

U.S. PATENT DOCUMENTS

| | | | | |
|---|---|---|---|---|
| 2010/0109499 | A1 | 5/2010 | Vilgiate et al. | |
| 2012/0170262 | A1* | 7/2012 | Hoetzl | F21V 29/004 362/227 |
| 2012/0311849 | A1 | 12/2012 | Lee | |

FOREIGN PATENT DOCUMENTS

| | | | |
|---|---|---|---|
| DE | 10 2009 035 517 | A1 | 2/2011 |
| DE | 10 2011 004 022 | A1 | 8/2012 |
| EP | 2 530 377 | A1 | 12/2012 |

OTHER PUBLICATIONS

International Search Report and Written Opinion in corresponding International Application No. PCT/EP2015/052283 dated Mar. 12, 2015 (5 pages—English Translation included).

* cited by examiner

*Primary Examiner* — Stephen F Husar
(74) *Attorney, Agent, or Firm* — Hayes Soloway PC

(57) ABSTRACT

The semiconductor lamp (1) is equipped with a heat sink (2, 3) which has a first part (2) and a second part (3) connected to each other by way of a press fit and which together delimit a receptacle (10, 12) for a driver (5), the first part (2) having an insert region (8) for insertion into the second part (3), which insert region consists of spring elements (21) that can be pushed inwards. The invention is particularly useful for retrofit lamps, in particular incandescent or halogen retrofit lamps.

10 Claims, 3 Drawing Sheets

SEMICONDUCTOR LAMP HAVING A HEAT SINK

CROSS-REFERENCE TO RELATED APPLICATIONS

This application is the U.S. national phase entry under 35 U.S.C. § 371 of International Application No. PCT/EP2015/052283, filed on Feb. 4, 2015, which claims priority to German Patent Application No. 10 2014 203 192.3, filed on Feb. 21, 2014.

The invention relates to a semiconductor lamp having a heat sink which comprises a first part and a second part which are connected together by means of a press fit and together delimit a cavity for a driver. The invention is applicable in particular to retrofit lamps, in particular incandescent or halogen retrofit lamps.

Retrofit lamps as a replacement for conventional incandescent lamps are known, which retrofit lamps comprise a metal base body having a driver cavity, wherein there is a lamp base at a rear end of the base body and a plurality of LEDs are attached to a front end of the base body. In order to dissipate heat from the LEDs, the base body is covered with an injection-moulded cooling element of aluminium, which then covers a lateral surface of the base body. The driver cavity is lined with a plastics sheathing in order to ensure that the base body and the cooling element are shock-proof. It is a disadvantage that the cooling element can be connected to the base body effectively only with high precision of the finished parts. The use of thermally conductive paste to compensate for tolerances results in poorer heat transfer and can additionally give the lamp a less high-quality appearance. Furthermore, such an incandescent retrofit lamp is expensive to produce.

The object of the present invention is to overcome at least some of the disadvantages of the prior art and in particular to provide a semiconductor lamp which can be cooled efficiently and which can be constructed in a simple manner using inexpensive materials.

The object is achieved according to the features of the independent claims. Preferred embodiments are to be found in particular in the dependent claims.

The object is achieved by a semiconductor lamp having a heat sink, which heat sink comprises a first part and a second part, wherein the two parts are connected together by means of a press fit and together delimit or form a receiving space for a driver, and wherein the first part has an insert region for insertion into the second part, which insert region consists of spring elements.

This semiconductor lamp has the advantage that a press fit is particularly simple to put into practice, and narrow tolerances do not need to be observed for the insert region. Adhesive or thermally conductive paste for ensuring an effective connection between the two parts is thus not necessary. The connection permits good heat transfer between the two parts. The second part can be shaped during its production for effective heat dissipation into the surroundings. The first part can be produced by simple means from inexpensive starting materials, for example from sheet iron or aluminium sheet.

Insertion may also be referred to, for example, as introduction, plugging in or pushing in. The insertion movement may be achieved by moving one of the two parts towards the other part, which is kept stationary, or by moving the two parts towards one another.

The first part and the second part can also be referred to as a "cover" and a "cup", respectively. Without loss of generality, it is assumed in the following that the second part has in particular at its rear end a base for connection to a suitable socket, for example an Edison screw base or a bi-pin base. At its front end, the second part has in particular an opening to a cavity situated in the second part. The first part, or cover, can then be inserted into the opening with a press fit and closes the cavity. The first part may in particular project forwards so that the receiving space for accommodating the driver is then formed overall by means of the cavity of the second part and a curved portion of the first part. For example, the driver (for example a drive electronics) may first be inserted at least partly into the cavity and then the first part can be fitted.

The first part serves in particular as a carrier for at least one semiconductor light source. Preferably, the at least one semiconductor light source comprises at least one light-emitting diode. Where a plurality of light-emitting diodes are present, they can emit light of the same colour or of different colours. A colour can be monochromatic (for example red, green, blue, etc.) or polychromatic (for example white). The light emitted by the at least one light-emitting diode can also be infra-red light (IR-LED) or ultraviolet light (UV-LED). A plurality of light-emitting diodes can generate blended light; for example white blended light. The at least one light-emitting diode can contain at least one wavelength-converting luminescent substance (conversion LED). Alternatively or additionally, the luminescent substance can be arranged apart from the light-emitting diode ("remote phosphor"). The at least one light-emitting diode can be in the form of at least one individually housed light-emitting diode or in the form of at least one LED chip. A plurality of LED chips can be mounted on a common substrate ("submount"). The at least one light-emitting diode can be equipped with at least one separate and/or common lens system for beam guidance, for example at least one Fresnel lens, collimator, etc. Instead of or in addition to inorganic light-emitting diodes, for example based on InGaN or AlInGaP, organic LEDs (OLEDs, for example polymer OLEDs) can generally also be used. Alternatively, the at least one semiconductor light source can have, for example, at least one diode laser.

The first part is preferably made of metal, for example aluminium, which permits effective heat dissipation from the at least one semiconductor light source to the first part. The first part may in particular be a sheet-metal part which has been formed, for example, by shaping. It may, however, also be a cast part or a pressed part, for example. Electrical connections of the driver can in particular be guided through the first part.

Because the insert region consists of spring elements, it is possible to achieve firm and precise insertion without observing narrow tolerances during production. The spring elements adapt to the shape of the second part, into which they are inserted, by resilient bending. The spring elements further effect self-centring. The spring elements can in particular be pushed inwards in order to bring the first part into a press fit simply by inserting it into the opening.

In an embodiment that is particularly simple to produce, the insert region is in the form of an annular insert region having a plurality of slots on one side. A particularly large contact surface with the second part is thus provided. Without slots there would be no significant resilient bending of the insert region inwards, which requires considerably narrower manufacturing tolerances.

An outside diameter of the annular insert region may in particular be slightly larger than an inside diameter of a circular opening of the second part, so that the spring elements bend automatically when they are inserted into the opening. In particular, an outside diameter of the second part at the level of the opening can be larger than the outside diameter of the annular insert region.

In a further development, the slots start from a rear edge of the insert region, the insert region first being introduced into the second part with that rear edge leading. They can be oriented parallel to an axis of symmetry of the annular insert region. The slots can be oriented, for example, parallel to an introduction direction of the two parts. Adjacent slots can be spaced apart equidistantly from one another.

The slots can extend from the rear edge to a front end of the annular insert region. This permits a particularly large degree of bending of the spring elements. However, the slots can also be shorter, for example can extend over only half the height of the annular insert region. This permits a higher resilient restoring force with the same penetration depth as compared with longer slots.

In a further embodiment, the insert region is sloping on its outer side starting from its rear end. This facilitates the introduction of the insert region into the second part.

In yet a further embodiment, the first part has a hollow cylindrical basic shape which is closed at the front and the insert region of which is formed by the side wall. This shape is particularly simple and inexpensive to produce. Slots can be oriented parallel to a longitudinal axis of the first part. They begin in particular at the rear free edge. The front end face or top surface can be used as the carrier surface for the at least one semiconductor light source.

In a further embodiment, the second part has at least one inwardly directed slope at its opening for insertion of the first part, on which slope the spring elements of the first part are able to bear when they are inserted. This also facilitates the introduction of the insert region into the second part. In particular, the externally sloping edge of the insert region of the first part and the inwardly sloping opening of the second part can come together upon insertion, which particularly facilitates introduction.

In an additional embodiment, the second part has a cup-shaped metal body which is partly covered by an electrically insulating plastics sheathing and is exposed in its front region in particular only on the inside for engagement with the insert region of the first part. The metal body thus also has a front opening. The exposed part may serve at least in part as the contact region with the inserted first part. This embodiment has the advantage that it is shock-proof and avoids many air gaps and creepage distances. A separate electrically insulated insert in the receiving space is thus not necessary. In addition, all the surfaces which may typically be touched during use can be electrically insulated on the outside. The fact that the metal body is exposed in its front region effects direct contacting of metal to metal with the spring elements and thus particularly effective heat transfer from the at least one semiconductor light source to the first part, further to the metal body and then through the plastics sheathing to the surroundings. Particularly effective cooling is thus achieved in a simple manner. The metal body may, for example, be exposed only in that region and optionally in a rear region for connection with a base element (for example a cap for an Edison screw base).

A second part according to this embodiment may be achieved, for example, by injection moulding plastics material around the metal body.

In a further development, the metal body is bent outwards at the edge in its front region. As a result, the inwardly directed slope in particular may be formed in a simple manner, for example without removing material. The front region of the cup-shaped metal body may in other words have a collar—in particular a peripheral collar.

Moreover, in one embodiment the bent edge of the cup-shaped metal body is received at its forwardmost portion by the plastics sheathing and the plastics sheathing is in the form of an introduction slope on the inside. This improves even further the ability of the insert region or of the spring elements of the first part to be introduced since, when the rear edge of the insert region meets the introduction slope of the plastics sheathing, it is bent inwards by the plastics sheathing as it is inserted further or introduced further into the second part.

In a further embodiment, the introduction slope of the plastics sheathing merges into the inwardly directed slope of the metal body. As they are inserted further, the spring elements of the first part thus pass from the introduction slope of the plastics sheathing onto the inwardly directed slope of the metal body, whereby they are bent even further. The use of these two inwardly leading sloping surfaces in succession in the insertion direction permits a particularly non-sensitive possibility of an introduction or insertion process as compared with a mutual lateral offset of the two parts.

In addition, in one embodiment the second part has on the inside at least one stop for the insert region of the first part. A precise depth of insertion of the first part in the second part can thus be specified in a simple manner. The stop may be formed, for example, by means of the plastics sheathing. In a further development, the plastics sheathing has as the stop at least one projection, for example rib, which projects into the cavity. For a tilt-proof stop, three projections distributed in the peripheral direction are preferably used, but it is in principle also possible to use only one, two or more than three stops.

The above-described properties, features and advantages of this invention, as well as the manner in which they are achieved, will become clearer and more readily understandable in connection with the following schematic description of an embodiment, which is explained in greater detail in connection with the drawings. For the sake of clarity, elements that are the same or have the same effect can be provided with the same reference numerals.

Figure 1:
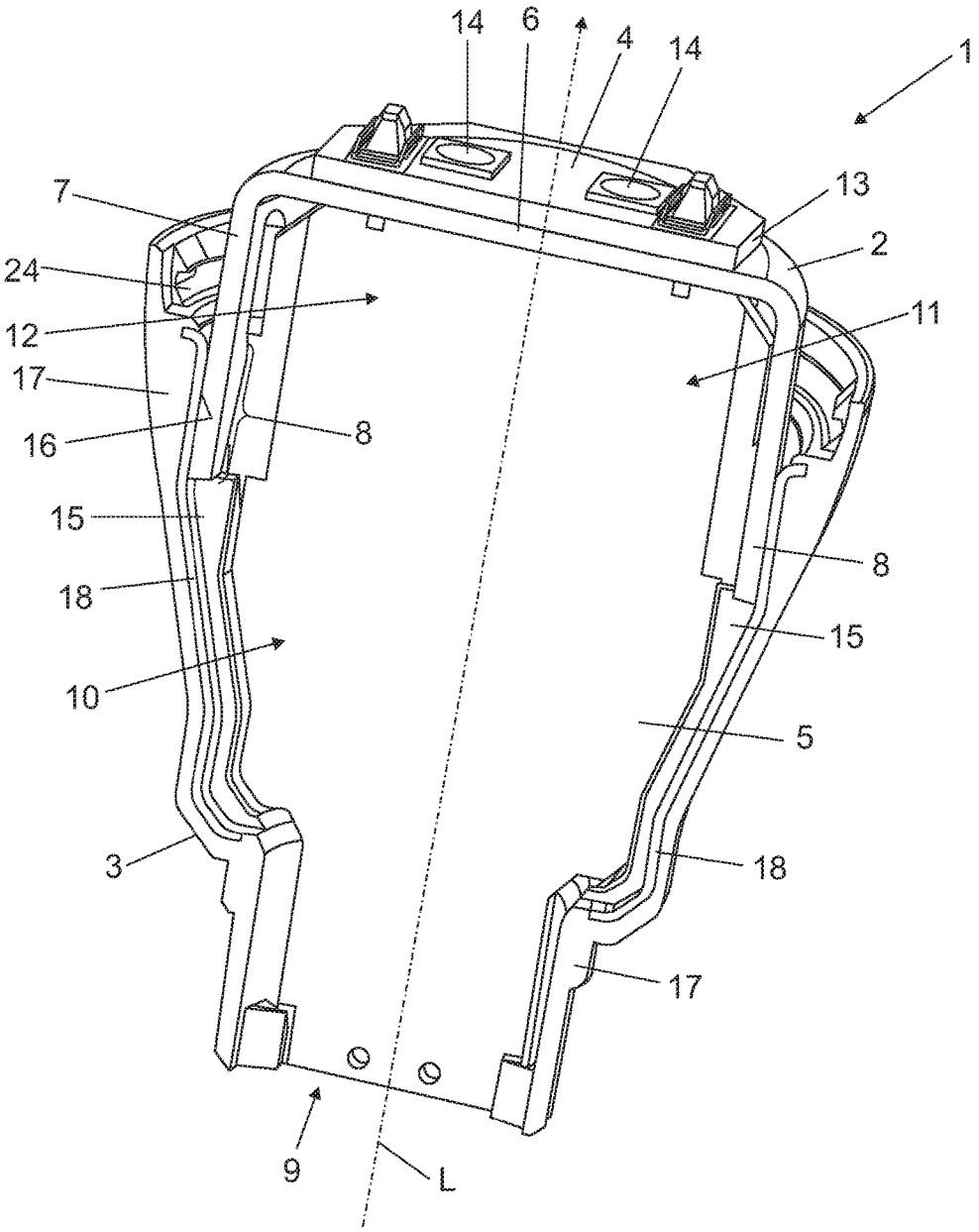
FIG. 1 is an oblique view, as a sectional representation, of parts of an assembled semiconductor lamp according to the invention.

FIG. 1 shows an oblique view, as a sectional representation, of a plurality of parts of an assembled semiconductor lamp in the form of an LED bulb retrofit lamp 1, namely a first part in the form of a cover 2, a second part in the form of a cup 3, a semiconductor light source module in the form of an LED submount 4, and a driver in the form of a driver board 5. The lamp 1 has a longitudinal axis L which extends from back to front.

The cover 2 has a hollow cylindrical basic shape, which is open at the rear and is closed at the front by an end wall 6. The end wall 6 is followed at the sides by a lateral surface in the form of an annular side wall 7. The side wall 7 serves with its rear half as an insert region 8 for insertion into the cup 3.

To that end, the cup 3 has an elongate shape, open at the front and at the rear, which widens at least in portions in the direction of the longitudinal axis L, or towards the front. A base element (not shown, for example an Edison screw base), for example, can be fitted to a rear opening 9 and connected electrically to the driver board 5 in order to supply power thereto. The driver board 5 is partly inserted in a cavity 10 of the cup 3, whereby it projects through a front opening 11 of the cup 3. The driver board 5 has one or more electrical and/or electronic components (not shown), which convert the electrical signals (for example an alternating voltage signal) fed in via the base element into electrical signals suitable for operating the LED submount 4.

The cover 2 is so connected to the cup 3 that the cover 2 with its inner curved portion 12 and the cavity 10 of the cup 3 together form a receiving space 10, 12 for the driver board 5. The cover 2 and the cup 3 consequently delimit or form the receiving space 10, 12.

The end wall 6 of the cover 2 is broken in order to allow electric leads (not shown) to pass from the driver board 5 to the LED submount 4 situated at the front on the end wall 6. The cover 2 thus serves as a carrier for the LED submount 4. The electric leads guide electrical operating signals generated by the driver board 5 to the LED submount 4. The LED submount 4 has a plate-like ceramics substrate 13, the front of which is provided with a plurality of LED chips 14. The LED chips 14 can emit white light, for example.

The cover 2 is connected to the cup 3 by means of a press fit. To that end, the cover 2 has been inserted by means of the part of its side wall 7 that serves as the insert region 8 into the front opening 11 of the cup 3, until it abuts a plurality of stop regions 15 of the cup 3 projecting into the cavity 10. The stop regions 15 end at the same height in relation to the longitudinal axis L. When the press fit is present, the insert region 8 is in contact with an exposed contact region 16 on the inside, or in the direction of the cavity 10, of a metal body 18 which is otherwise enclosed by a plastics sheathing 17. The metal body 18 is likewise in the form of a cup having a rear and a front opening and is at least substantially of a similar shape to the associated portion of the cup 3 along the longitudinal axis L.

The plastics sheathing 17 forms on the inside the rib-like stop regions 15 and has on its front side a receiver 24 in the form of an annular groove for a bulb (not shown).

Figure 2:
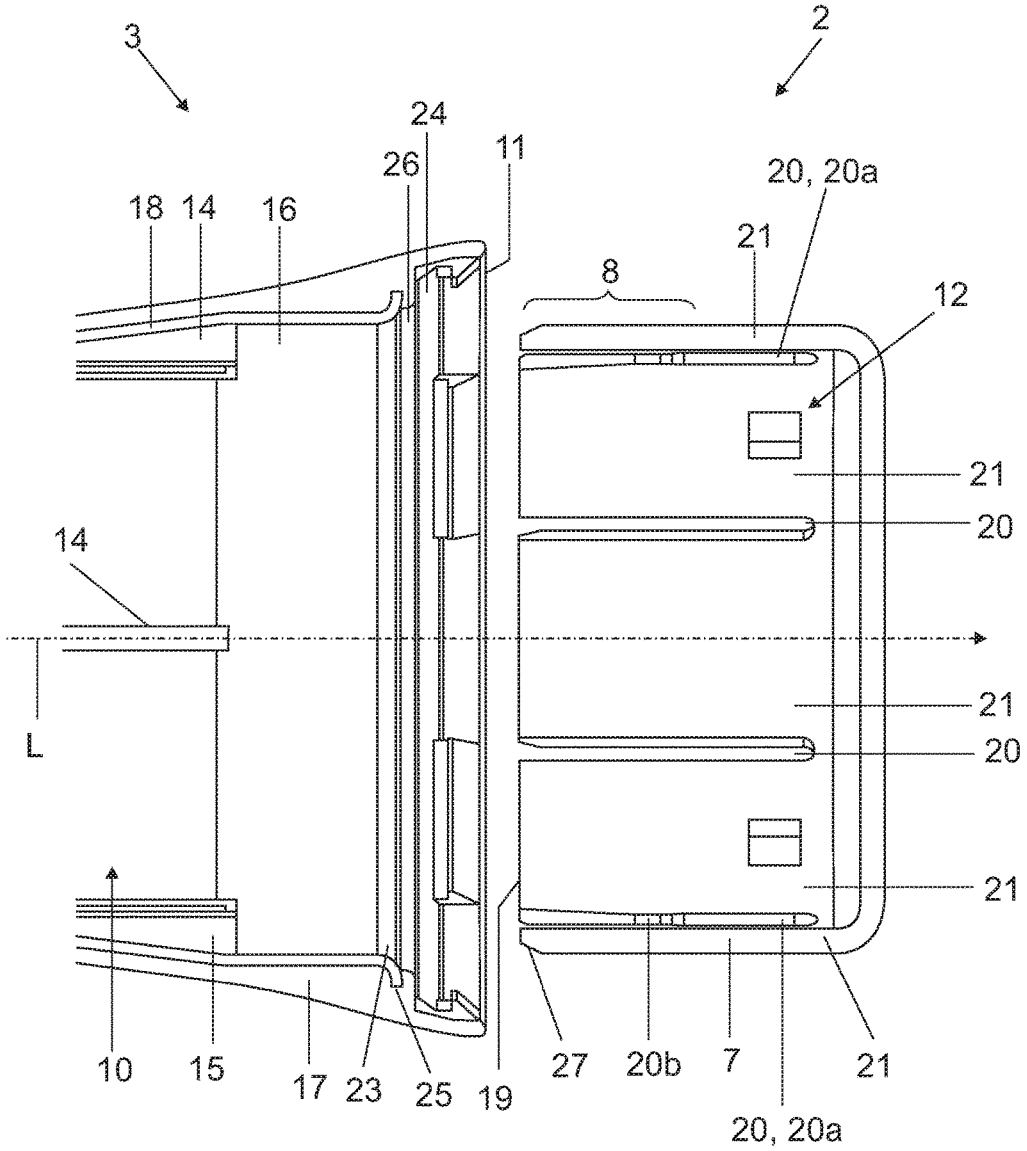
FIG. 2 is an exploded side view, as a sectional representation, of a portion of a first and a second part of the semiconductor lamp according to the invention.

As is shown in FIG. 2, the side wall 7 of the cover 2 has a plurality of slots 20 extending parallel to the longitudinal axis L, which slots begin at a rear edge 19 of the side wall 7. The slots 20 here extend over a large part of a height (along the longitudinal axis L) of the side wall 8. Owing to the slots 20, the regions of the side wall 7 that are broken thereby become spring elements 21. The spring elements 21 can be pushed resiliently inwards or outwards. The insert region 8 of the cover 2 thus consists of a plurality of spring elements 21 arranged annularly in a circumferential direction about the longitudinal axis L. Since an outside diameter of the insert region 8 of the cover 2 is slightly larger than an inside diameter of the contact region 16 of the cup 3, the spring elements 21 are pushed inwards when the cover 2 is inserted. The cover 2 is then held in the cup 3 by their resilient force.

A pair of mutually opposite slots 20*a* each have a narrowed portion 20*b* in order to be able to bring that portion into friction-based engagement with the driver board 5. Consequently, the cover 2 also serves as a holder and optionally guide for the driver board 5.

Figure 3:
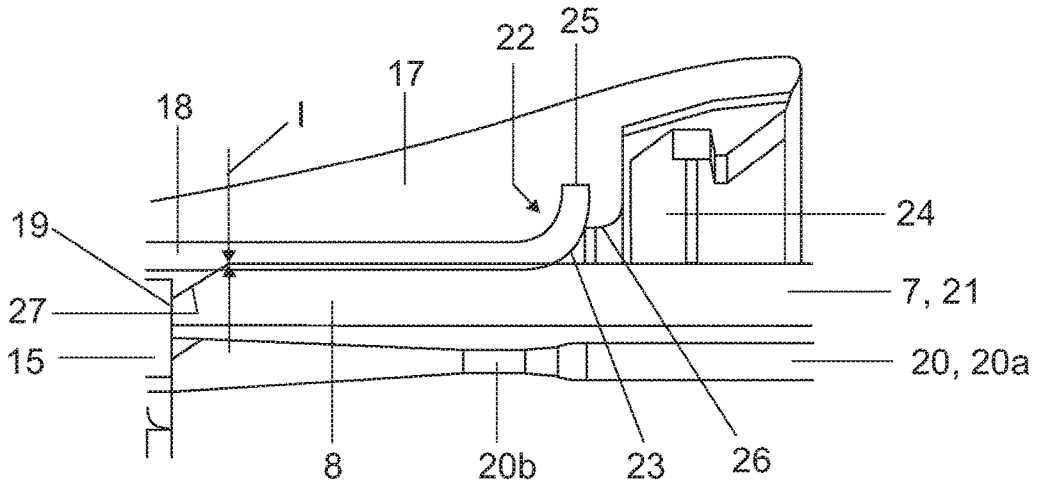
FIG. 3 shows in part the first part and the second part inserted into one another without taking into consideration a deformation in a contact region.
Figure 4:
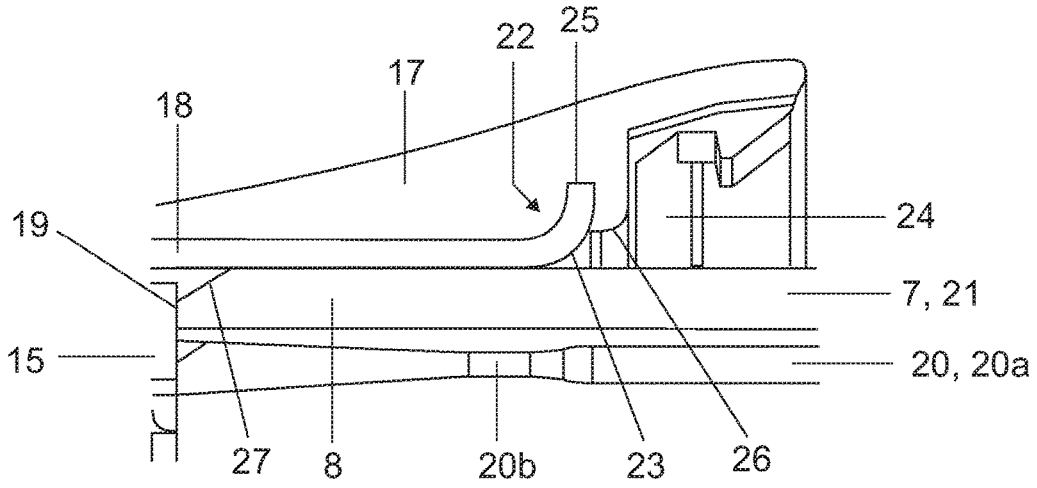
FIG. 4 shows in part the first part and the second part inserted into one another taking into consideration the deformation in the contact region.

FIG. 3 shows a graphic superposition of part of the cover 2 and of the cup 3 with the cover 2 inserted, wherein the spring elements 21 are relaxed, or not pushed inwards by the press fit. In this case, there is an overlap of a lateral depth I. In the real case shown in FIG. 4, the spring element 21 is bent inwards by that depth I, so that the resilient restoring force is generated, which effects the press fit.

As is shown in all the figures, the metal body 18 is bent outwards in a rounded manner at its front edge 22 in the manner of a collar. An inwardly directed slope 23 for the cover 2 is thus produced, which facilitates insertion of the cover 2. For the same purpose, the bent edge 22 of the cup-like metal body is received in its forwardmost portion 25 by the plastics sheathing 17. The plastics sheathing 17 is rounded on the inside in that region and thus likewise has the form of an introduction slope 26. The introduction slope 26 merges into the slope 23. For the purpose of simple introduction which is not susceptible to faults, the insert region 8 additionally has, or the spring elements 21 have on their outer side, starting from their rear edge 19, a further slope 27 which widens in the longitudinal direction L.

Although the invention has been illustrated and described in detail by means of the embodiment shown, the invention is not limited to that embodiment and other variations can be derived therefrom by the person skilled in the art, without departing from the scope of protection of the invention.

In general, "a" can be understood as meaning a singular or a plural, especially in the sense of "at least one" or "one or more", etc., provided that this is not explicitly excluded, for example by the expression "exactly one", etc.

A figure can also include exactly the indicated number as well as a conventional tolerance range, provided that this is not explicitly excluded.

REFERENCE NUMERALS

1. LED bulb retrofit lamp
2. Cover
3. Cup
4. LED submount
5. Driver board
6. End wall
7. Side wall
8. Insert region of the side wall
9. Rear opening of the cup
10. Cavity of the cup
11. Front opening of the cup
12. Inner curved portion of the cover
13. Ceramics substrate
14. LED chip
15. Stop region
16. Contact region of the metal body
17. Plastics sheathing
18. Metal body
19. Rear edge of the insert region
20. Slot
20*a*. Slot with narrowed portion
20*b*. Narrowed portion of the slot
21. Spring element
22. Front edge of the metal body
23. Slope
24. Receiver in the form of an annular groove
25. Forwardmost portion of the edge of the metal body

26. Introduction slope
27. Slope
I Depth
L Longitudinal axis

We claim:

1. A semiconductor lamp having a heat sink which comprises a first part and a second part which are connected together by means of a press fit and which together delimit a receiving space for a driver, wherein the first part has an insert region for insertion into the second part, which insert region consists of spring elements which can be pushed inwards.

2. The semiconductor lamp according to claim 1, wherein the insert region is in the form of an annular insert region having a plurality of slots on one side.

3. The semiconductor lamp according to claim 1, wherein the insert region is sloping on its outer side starting from its rear edge.

4. The semiconductor lamp according to claim 1, wherein the first part has a hollow cylindrical shape which is closed at the front and the insert region of which is formed by a side wall.

5. The semiconductor lamp according to claim 1, wherein the second part has at its opening for insertion of the first part at least one inwardly directed slope on which the spring elements of the first part are able to bear during their insertion.

6. The semiconductor lamp according to claim 5, wherein the second part has a cup-shaped metal body which is partly covered by a plastics sheathing and which is exposed in its front region for engagement with the insert region of the first part and is there bent outwards at the edge to form the inwardly directed slope.

7. The semiconductor lamp according to claim 6, wherein the bent edge of the cup-shaped metal body is received in its forwardmost portion by the plastics sheathing, and the plastics sheathing is formed on the inside as an introduction slope.

8. The semiconductor lamp according to claim 7, wherein the introduction slope of the plastics sheathing merges into the inwardly directed slope of the metal body.

9. The semiconductor lamp according to claim 1, wherein the second part has on the inside at least one stop for the insert region of the first part.

10. The semiconductor lamp according to claim 1, wherein the semiconductor lamp is a retrofit lamp, the second part has a base at the back, and the first part serves as a carrier for at least one semiconductor light source.

* * * * *